US007044321B2

(12) United States Patent
Smith et al.

(10) Patent No.: US 7,044,321 B2
(45) Date of Patent: May 16, 2006

(54) SCHOOL SUPPLY STATION

(75) Inventors: Aaron W. Smith, Wooster, OH (US); Timothy D. Killinger, Wooster, OH (US)

(73) Assignee: Rubbermaid Incorporated, Wooster, OH (US)

( * ) Notice: Subject to any disclaimer, the term of this patent is extended or adjusted under 35 U.S.C. 154(b) by 184 days.

(21) Appl. No.: 10/442,354

(22) Filed: May 21, 2003

(65) Prior Publication Data

US 2004/0232147 A1 Nov. 25, 2004

(51) Int. Cl.

| | |
|---|---|
| ***B65D 1/22*** | (2006.01) |
| ***B65D 1/36*** | (2006.01) |
| ***B65D 21/00*** | (2006.01) |
| ***B65D 25/04*** | (2006.01) |

(52) U.S. Cl. ..... 220/23.87; 220/527; 220/528; 220/554; 220/555

(58) Field of Classification Search ..... 220/23.87, 220/500, 527, 553–556, 23.2, 551, 505, 23.88, 220/528, 506; 206/518, 561

See application file for complete search history.

(56) References Cited

U.S. PATENT DOCUMENTS

| | | | | | |
|---|---|---|---|---|---|
| 5,086,917 | A | * | 2/1992 | Dziersk et al. | 206/216 |
| 5,154,303 | A | * | 10/1992 | Jordan | 220/23.86 |
| 5,441,164 | A | * | 8/1995 | Beck et al. | 220/575 |
| 5,593,061 | A | * | 1/1997 | Prochnow | 220/507 |
| D397,582 | S | * | 9/1998 | Sussman | D7/553.4 |
| D419,869 | S | * | 2/2000 | Loew et al. | D9/761 |

* cited by examiner

*Primary Examiner*—Jes F. Pascua
*Assistant Examiner*—Niki M. Eloshway
(74) *Attorney, Agent, or Firm*—Marshall, Gerstein & Borun LLP

(57) ABSTRACT

A school supply station for storing classroom items includes an annular inner wall that defines an interior bin receiving area, an annular outer wall spaced radially outward from and connected to the inner annular wall by a series of bottom walls, and a plurality of divider walls oriented transverse to and extending between the inner wall and outer wall, thereby forming a series of compartments. A bin is removably disposed in the bin receiving area.

19 Claims, 7 Drawing Sheets

50
46
62
64
38
IV
IV
18
18
82
16
H1
H2
12
14
42
28
40
44

46
28
56
64
66
68
70
72
74
84
18
18
78
80
82
16
34
26
36
44
42
12
14
40

14
16
18
26
28
30
34
36
38
40
42
44
46
48
50
56
60
62
64
66
68
70
72
74
76
78
80
82
84
+R
X
IX

SCHOOL SUPPLY STATION

FIELD OF THE INVENTION

This disclosure relates to supply containers, and more particularly relates to compartmentalized supply stations.

BACKGROUND OF THE INVENTION

Teachers and parents are constantly looking for new resources to aid in the education process in the school room. Educators would ideally like to have cost effective products that are reusable for the students to use. Further, educators need multipurpose items that organize the supplies that the students use while performing their lessons.

In classes with specialized supplies such as art, teachers generally place these supplies in a centralized location such that they are accessible for all students. For example, paint brushes, charcoal, sponges, as well as construction paper must all be laid out. Teachers generally want these supplies to be laid out and remain in an organized manner. To address this, teachers will use anything from cups, cans, baskets, or even silverware caddies. This looks sloppy, and does not guarantee that everything will remain organized or even be reachable for all students. Finally, these solutions do not provide a centralized location where a student can go to pick up every supply that he or she may need. Thus, there is a need for an organized storage container that maintains all the supplies that a student may need.

BRIEF DESCRIPTION OF THE DRAWINGS

Objects, features, and advantages of the present invention will be apparent upon reading the following description in conjunction with the drawing figures, in which.

DETAILED DESCRIPTION

Referring now to FIGS. 1–4, a centralized supply station 12 is disclosed. The supply station 12 includes a base 14 and a bin 16 removably disposed in the base 14. The supply station 12 has a vertical central axis 18, used as a reference to assist in describing the supply station 12.

In this example, the supply station 12 is radially symmetric about the central axis 18 as generally a four sided figure. Thus, in this example any element discussed herein can have three corresponding elements at 90°, 180°, and 270° from the first element, respectively, as measured rotationally around the central axis 18. This is purely for brevity and ease of understanding the drawings, as the supply station could have more or less sides, circular, or could even be radially asymmetric. Accordingly, no limitation should be taken in this regard.

Figure 5:
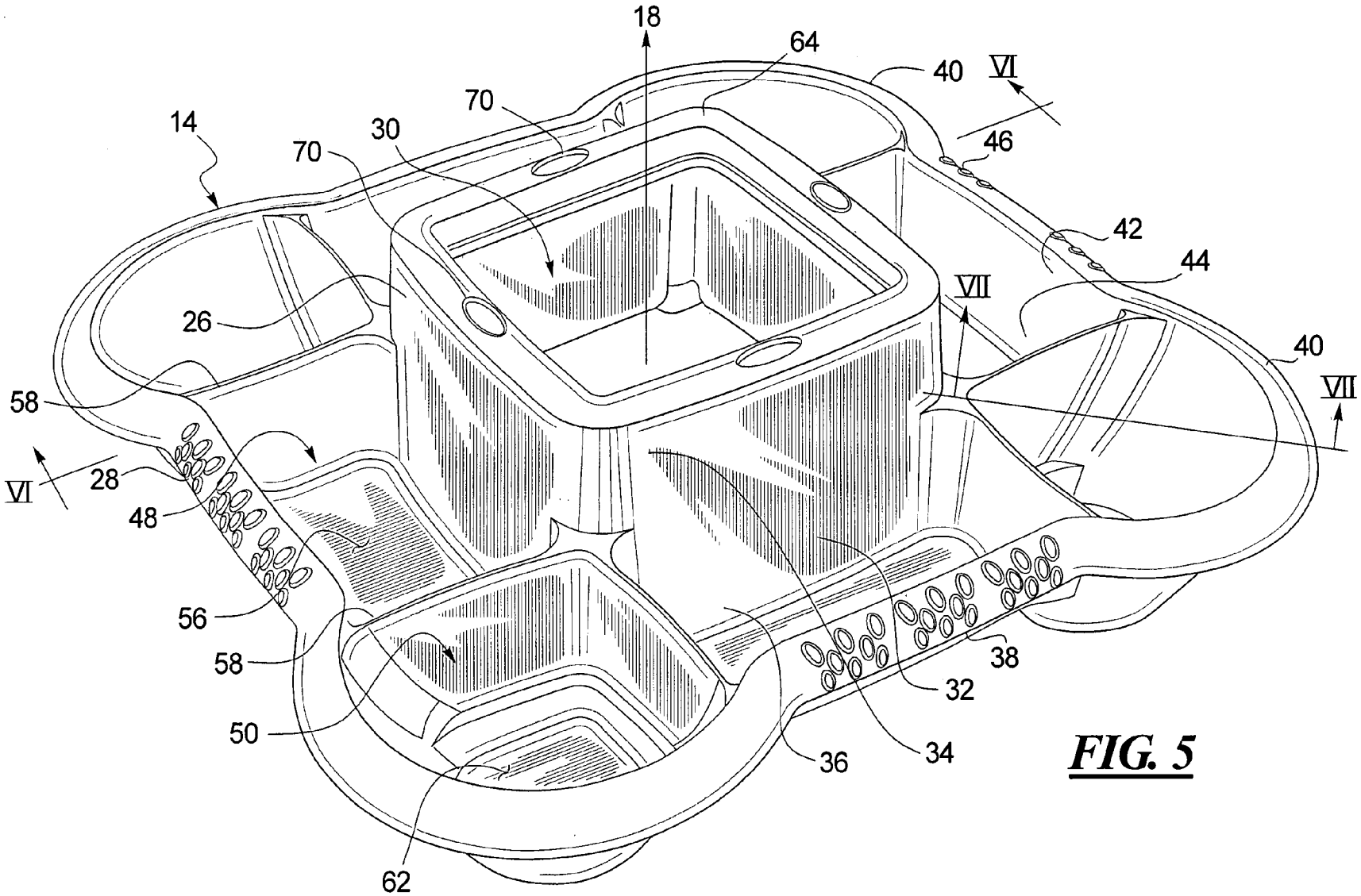
FIG. 5 is a perspective view of the base of the supply station.

As seen best in FIG. 5, the base 14 includes an annular inner wall 26, an annular outer wall 28, and a centralized opening interior to the inner wall 26 that defines a bin receiver 30. Referring back to FIGS. 1 and 2, the inner wall 26 includes a plurality of inner wall segments 32 that meet in corners 33, in a generally square-like shape. The inner segments 32 define planes that are generally parallel to the central axis 18. The inner wall 26 further has a top portion 34 and a bottom portion 36, defined in greater detail below.

The outer wall 28 includes an alternating series of outer wall mid-segments 38 that are disposed generally orthogonally to each other and confronting the inner wall segments 32. The outer wall 28 further includes outward extending curved corner sections 40, interconnecting the mid-segments 38 and confronting the corners 33. Referring back to FIG. 5, the outer wall 28 also includes a top portion 42 and a bottom portion 44, and is spaced radially outward from the inner wall 26 away from the central axis 18. On the top portion 42 of the outer wall 28 is a lip 46 that curls outward and downward. In this example, the top portion 34 of the inner wall 26 is higher than the top portion 42 of the outer wall 28.

Figure 1:
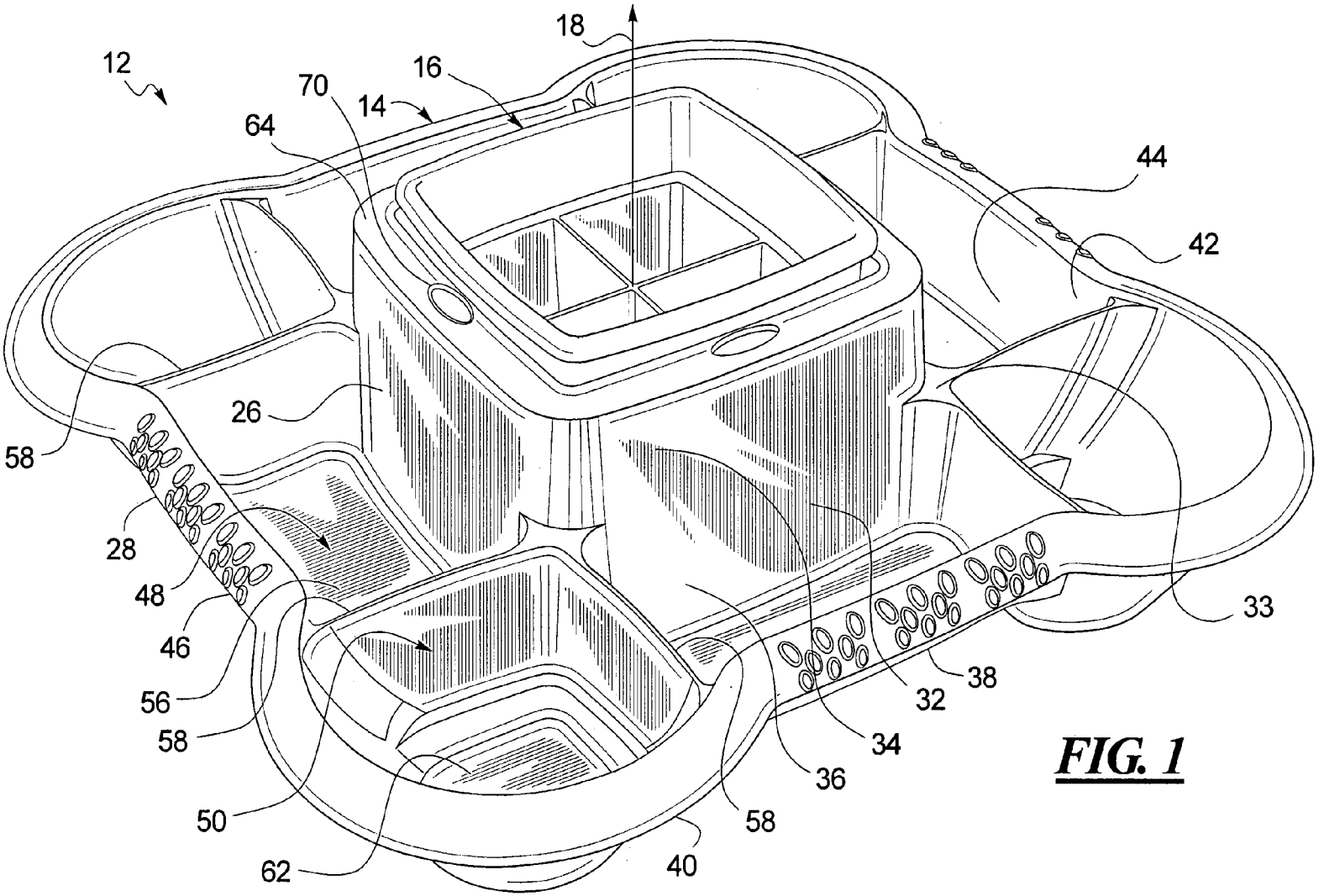
FIG. 1 is a perspective view of a supply station assembly constructed in accordance with the teachings of this disclosure.
Figure 2:
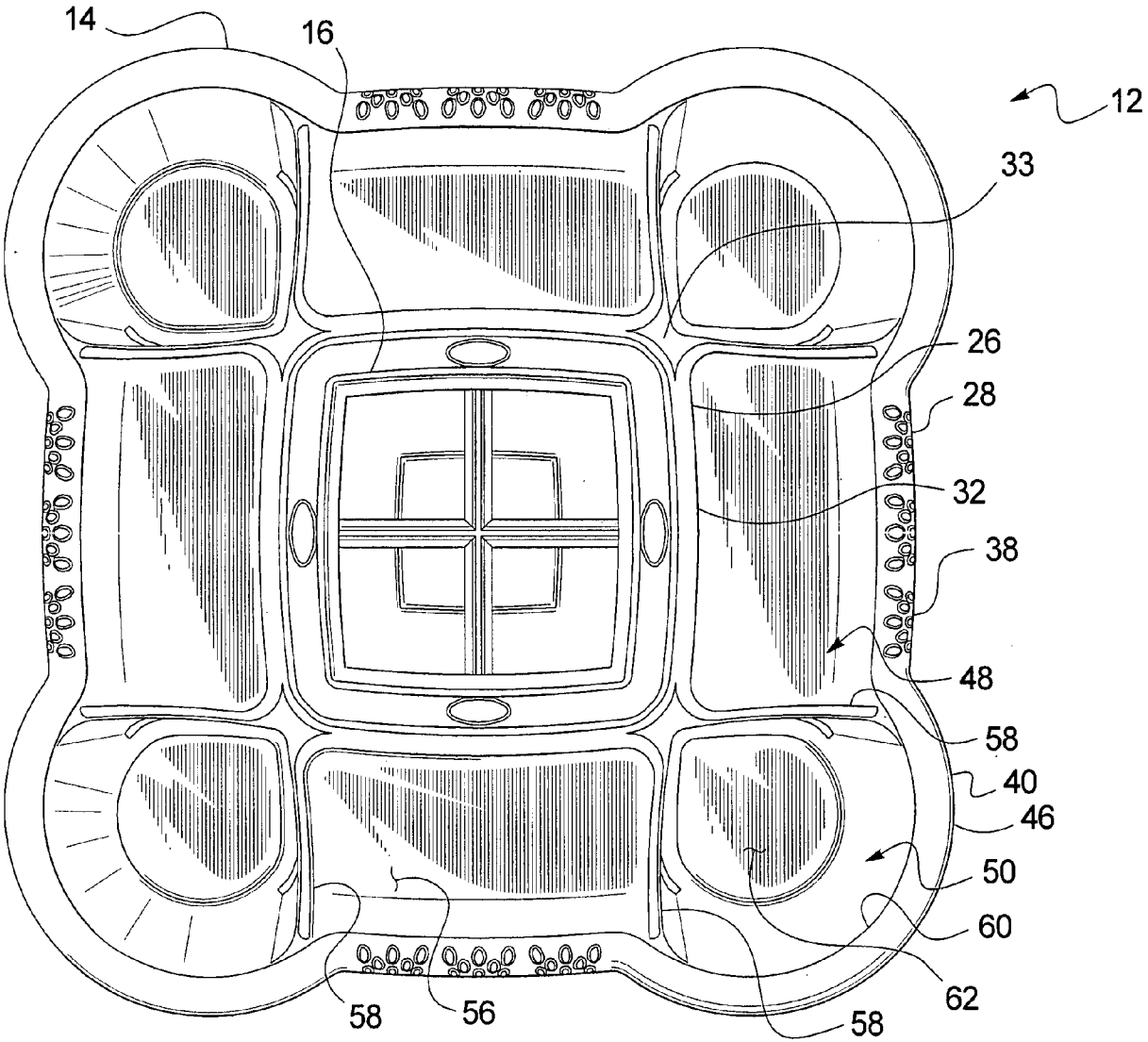
FIG. 2 is a top view of the supply station of FIG. 1.

Referring to FIG. 2, the space between the inner wall 26 and the outer wall 28 is divided into an alternating series of side compartments 48 and corner compartments 50. Each side compartment 48 includes an inner side, which in this example is defined by an inner segment 32 of an inner wall 26. Each side compartment 48 also includes an outer side, which in this example is defined by an outer segment 38 of the outer wall 28. Each side compartment 48 includes a bottom 56 extending between and connecting the bottom portion 36 of the inner wall 26 to the bottom portion 44 of the outer wall 28.

Each side compartment 48 includes a pair of transverse divider walls 58 extending from the inner wall 26 to the outer wall 28 and extending up from the bottom 56. In this example, the transverse divider walls 58 extend from the corners 33 away from the inner wall 26. The transverse divider walls 58, inner segments 32, outer mid-segments 38, and bottoms 56 define each side compartment 48 as a four-sided container with a closed bottom and an open top that can be used to store items.

Figures 6, 7, 8:
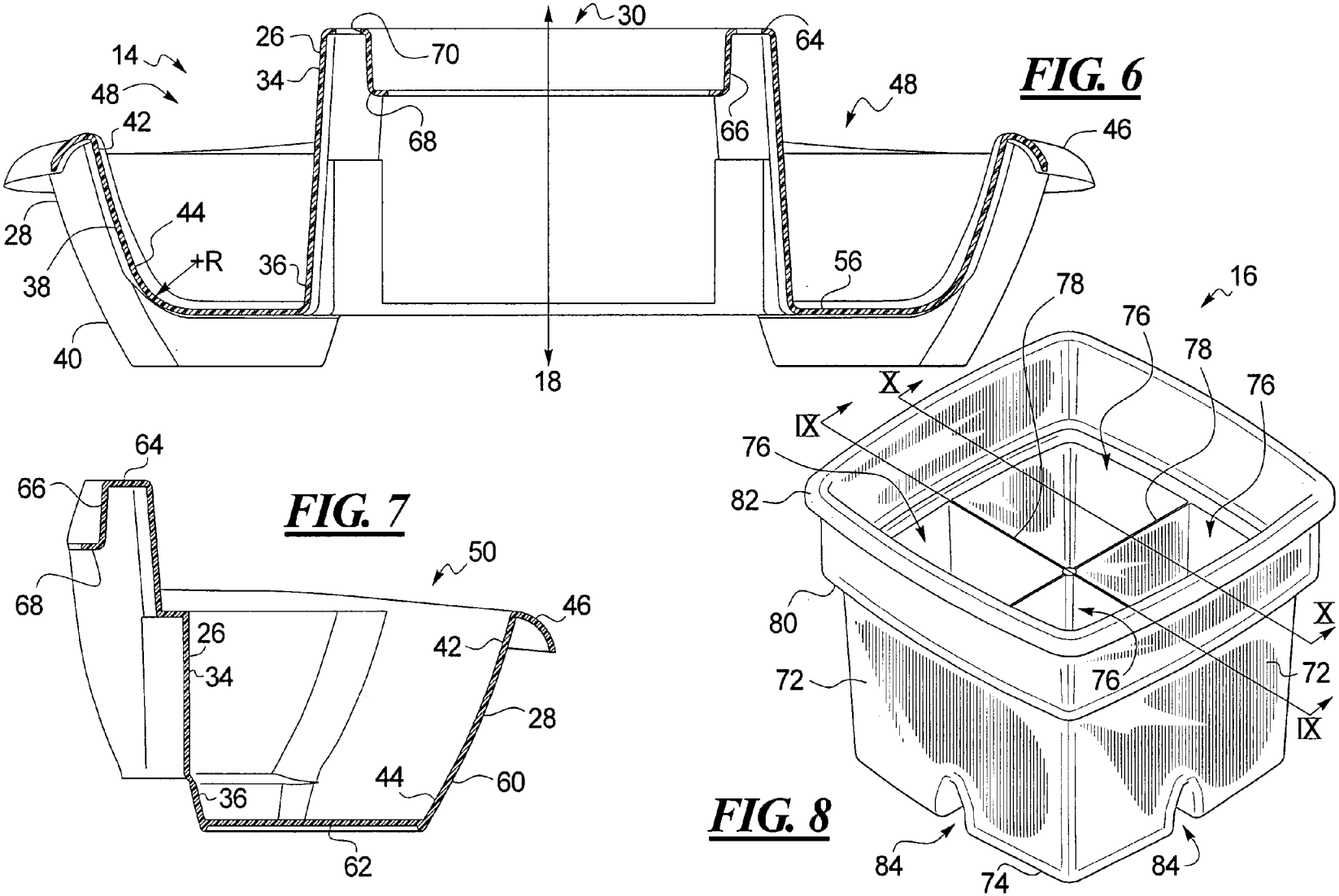
FIG. 6 is a cross-sectional view of the base taken along line VI—VI in FIG. 6.
FIG. 7 is a cross-sectional view of the base taken along line VII—VII in FIG. 7.
FIG. 8 is a perspective view of the bin of the supply station.

It can be seen in FIG. 6 that the outer mid-segments 38 of the side compartments 48 slope gently from the bottom to the top away from the central axis 18. The bottoms 56 connect to the outer mid-segments 38 at a gentle radius R transition approximately similar to the radius of a child's finger from the second knuckle to the tip of the finger. This enables children, whose dexterity is generally not as developed as it will be, to easily grasp any items deposited in the side compartments 48. The outer wall mid-segments 38 can also be gently curved outwardly to assist in the removal of items.

Irregularities have been placed on portions of the lip 46 to aid in grasping and maneuvering the supply station 12. Further, the lip 46 ensures that no sharp edges are showing that may injure a child and adds structural rigidity to the outer wall 26.

Again referring to FIG. 2, disposed between the side compartments 48 are a series of corner compartments 50 that are disposed between the transverse divider walls 58 of the side compartments 48, the transverse divider walls 58 also being employed by the corner compartments 50. Connecting the transverse sides 58 are the curved sections 40 of the outer wall 28. A bottom 62 extends between the transverse divider walls 58, the corner 33, and the curved section 40. Thus, the side compartments 48 extend out from the inner wall segments 32, while the corner compartments 50 extend out from the corners 33.

Figure 3:
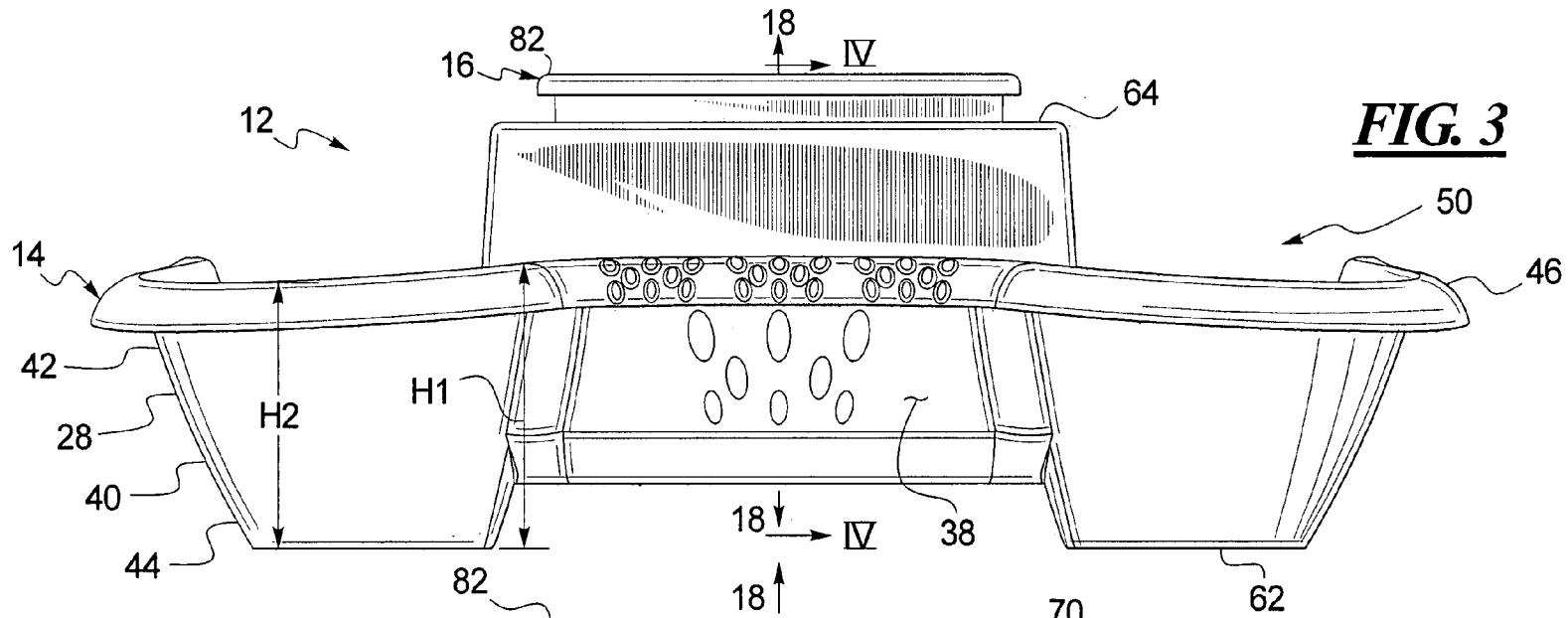
FIG. 3 is a side view of the supply station of FIG. 1.
Figure 4:
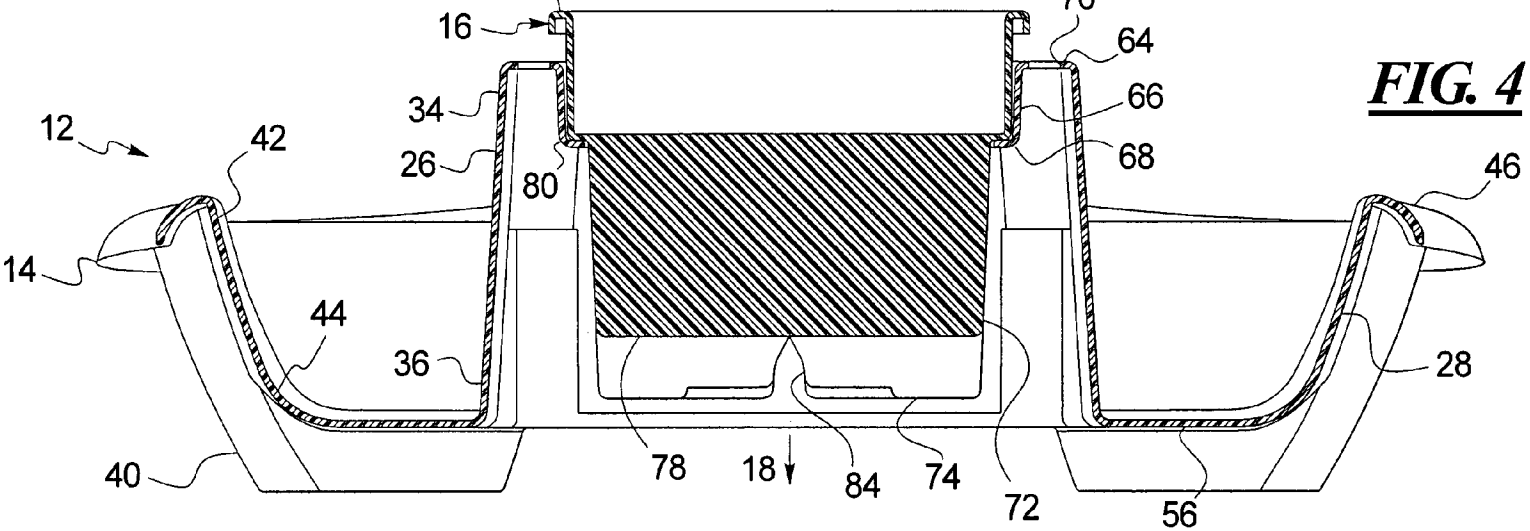
FIG. 4 is a cross-sectional view taken along line IV—IV in FIG. 3.

In this example, the bottoms 62 of the corner compartments 50 are lower than the bottoms 56 of the side compartments 48. Thus, the bottoms 62 of the corner compartments 50 serve as the bearing surface, supporting the entire supply station 12 on the surface on which it is placed. The curved sections 40 slope outward from the respective bottoms 62, in this example at an angle greater than the angle between the outer wall mid-segments 38 and the bottoms 56 of the side compartment 48. Because the corner compartments 50 are deeper than the side compartments 48, this gentler slope is helpful in the grasping and removal of items held therein. Further, as can be seen in FIG. 3, the curved sections 40 have a height H1 at the transverse divider wall 58, and a height H2 less than H1 at a point away from the transverse divider wall 58. Thus, the curved section 60 becomes vertically shorter further away from the transverse divider walls 58. This helps small children to reach in and access the contents of the corner compartment 50.

Seen best in FIG. 6, extending inward from the top portion 34 of the inner wall 26 is a rim 64. Extending down from the rim 64 is a neck 66, and extending inward from the neck 66 is a shoulder 68. The rim 64, neck 66, and shoulder 68 define the bin receiver 30. As will be seen, the neck 66 and shoulder 68 are useful in supporting the bin 16 in an elevated state.

A series of holes 70 are disposed in the rim 64. The holes 70 are useful for storing utensils, particularly elongated articles, that are ideally stored in a separate location from other commonly used utensils, or normally used separately from other utensils. This includes scissors, paint brushes, forks, and the like. The holes 70 can vary in size, shape and quantity. Thus, the rim 64, which is disposed between the inner wall segments 32 and the bin receiver 30, can also be used to store items. Further, these holes 70 release air when stacking multiple supply stations 12 in a nested configuration.

Figure 9:
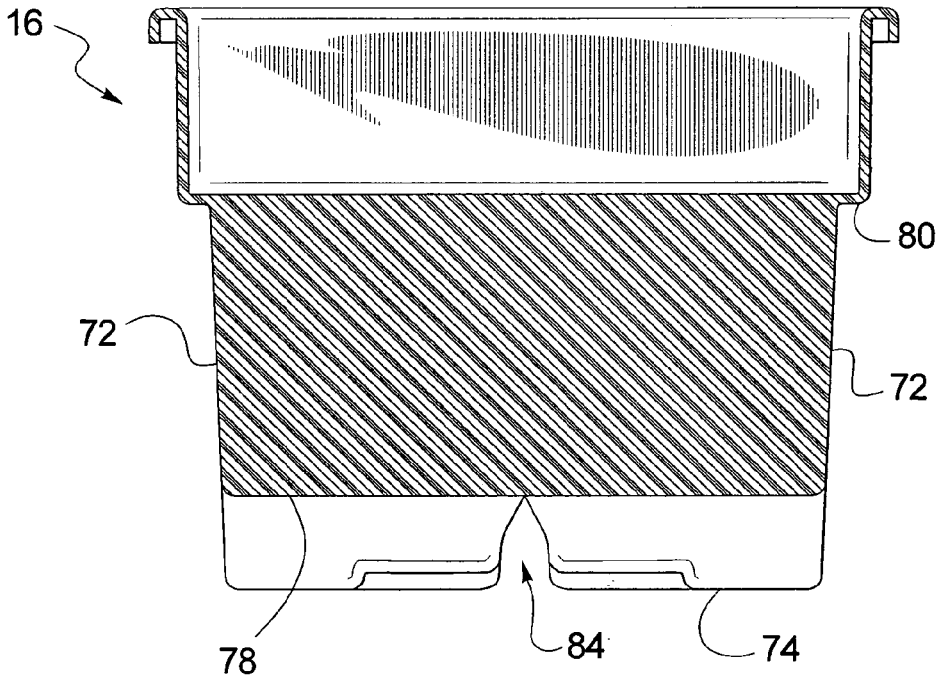
FIG. 9 is a cross-sectional view of the bin taken along line IX—IX in FIG. 8.
Figure 10:
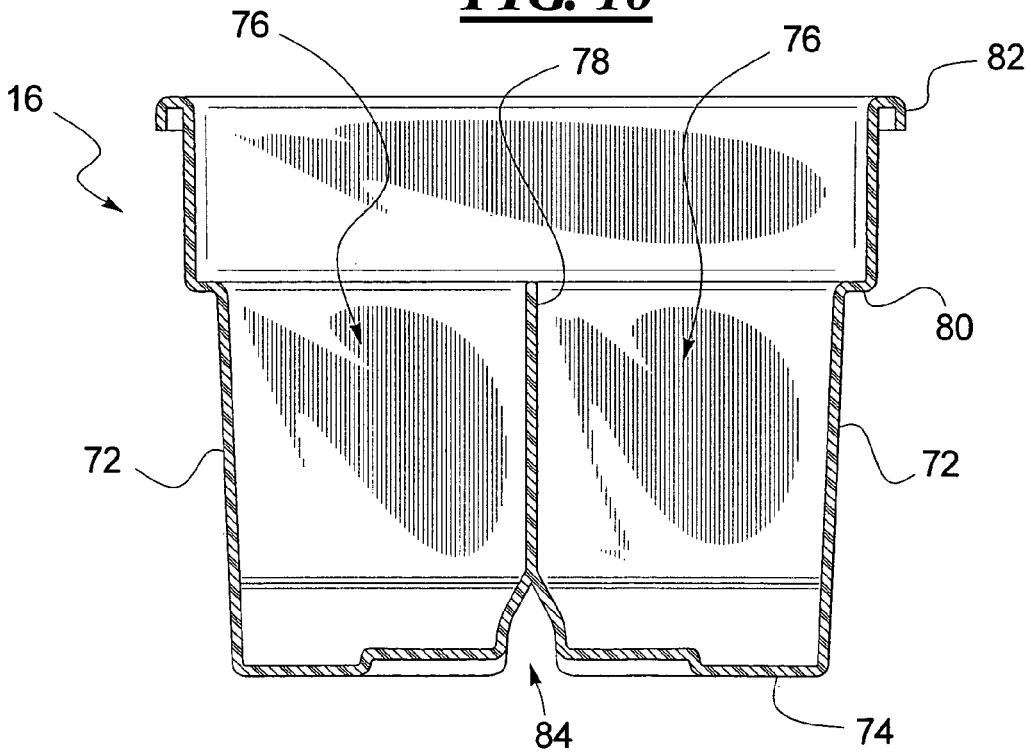
FIG. 10 is a cross-sectional view of the bin taken along line X—X in FIG. 8.

Now referring to FIGS. 8–10, removably disposed within the bin receiver 30 is the bin 16. The bin 16 includes four sides 72 and a bottom 74. The bin 16 includes chambers 76 that are connected to each other by dividers 78. In this example the bin 16 has two dividers 78 extending between the sides 72 and perpendicular to one another, partitioning the bin 16 into four chambers 76. The chambers 76 are vertically deeper than their horizontal cross sectional dimensions. In the present example, the ratio of the depth to width equals or exceeds 4:1. Accordingly, a supply of long and narrow objects such as pencils can be stored in an upright manner. Further objects with a dangerous element on one end, such as scissors, knives, or even pens, can be stored upright with their blades being oriented downward from any portion that a child could grab. Because there are several chambers 76, different items can be stored, one in each chamber 76, without getting mixed up.

Extending outward from the sides 72 is a shoulder 80. The bin 16 also includes a rim 82 extending outward and down from the top of the bin 16. The shoulder 80 may be disposed at or near the top of the dividers 78, but spaced from the rim 82. The chambers 76 are connected to each other through a portion of their height by the dividers 78. However, near the bottom of the bin 16, the chambers 76 split away from each other, and channels 84 in the bin 16 are formed between the chambers 76. The channels 84 are a pair of perpendicular or crisscrossing channels 84 extending up from the bottom of the bin 16.

When the bin 16 is inserted into the bin receiver 30 of the base 14, the shoulder 80 of the bin 16 bears on the shoulder 68 of the base 14 to maintain the bin 16 in a suspended state (see FIG. 4), such that the bottom 74 of the bin 16 does not touch the surface on which the supply station 12 is being supported. Further, the rim 82 of the bin 16 is maintained a distance above the rim 64 of the base 14, in this example approximately ⅝ of an inch. However, the spacing is effective if more than approximately ⅜". This allows for a user to easily grab the rim 82 of the bin 16 and remove the bin 16 from the base 14. In an alternative example, the rim 82 may rest on the base 14.

Figure 11:
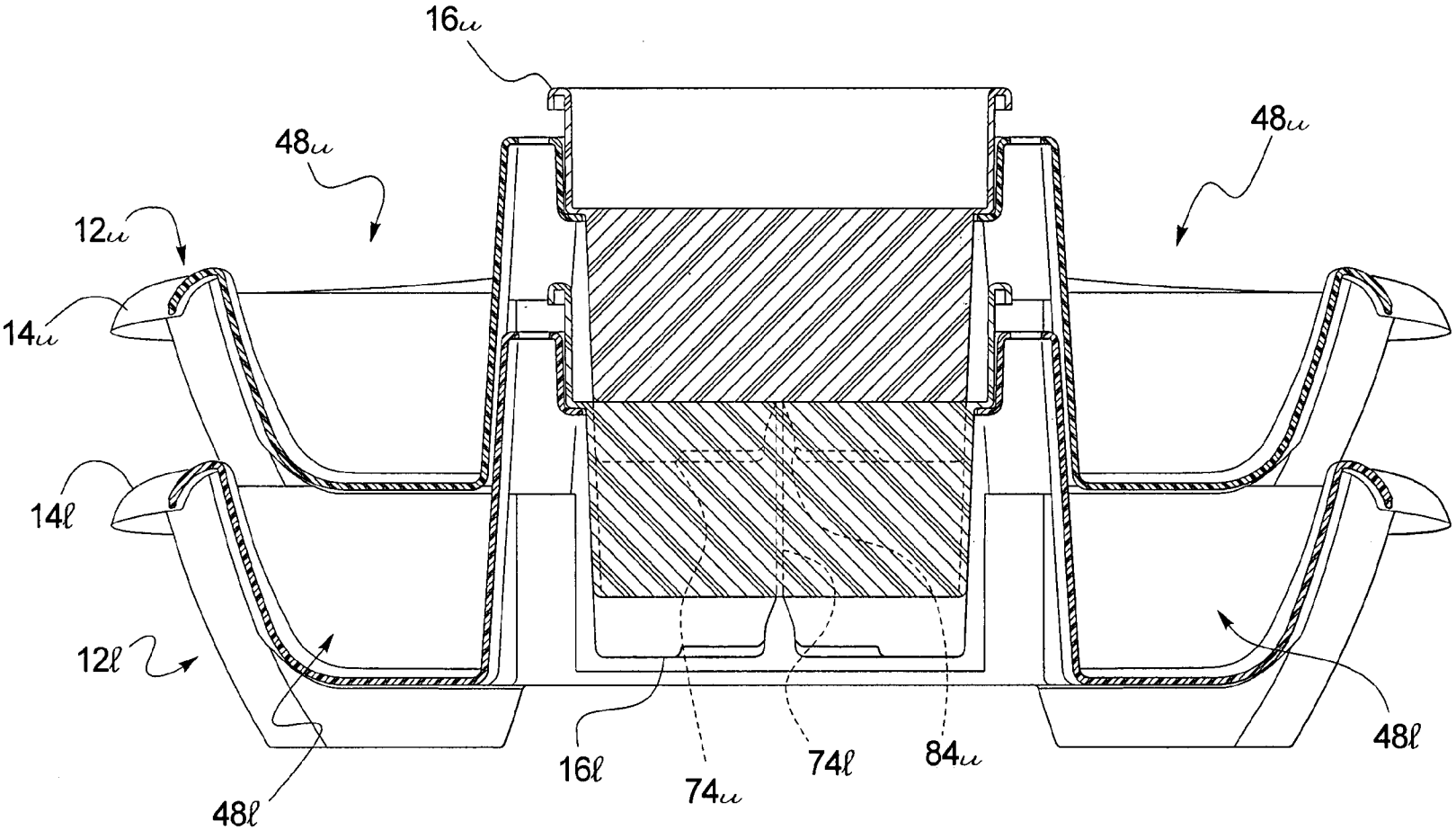
FIG. 11 is a cross-sectional view of a two stacked and nested supply stations.

The configurations of the base 14 and the bin 16 also allow for easy stacking of a plurality of supply stations 12. As shown in FIG. 11, an upper supply station 12*u* is nested within a lower supply station 12*l*. Each of the side compartments 48*u* and corner compartments (not shown) of the upper supply station 12*u* nest within the side compartments 48*l* and corner compartments (not shown) of the lower supply station 121 disposed below. Likewise, the bin 16*u* of the upper supply station 12*u* is nested within the bin 161 of the lower supply station 12*l*. The bottom of the upper bin 16*u* is inside the interior of the lower bin 161, with the channels 84*u* of the upper bin 16*u* straddling the dividers 78*l* of the lower bin 16*l*. Thus, the channels 84 allow for taller dividers 78 and deeper penetration of the upper bin 16*u* within the lower bin 16*l*. In this manner, the height of the nested supply stations 12 is maintained at a minimum. As the two supply stations 12 are nested, air trapped between the two can be released through the holes 70 in the rim 64 on the base 12.

In use, each of the side compartments 48 and corner compartments 50 can be assigned to individual students, while the bin 16 can contain shared tools and implements. Thus, each compartment 48, 50 contains a set of the same items so that four students can use the same station and each has access to the same set of items. Further, the bin 16 is removable, and as such can be passed around to each student to receive the implements, or can be brought to another location to replenish or change the contents held therein. This presents supplies in a better methodology for both individual and shared work stations. In another use, each side compartment 48 and corner compartment 50 can be stocked with different items From the foregoing, one of ordinary skill in the art will appreciate that the present disclosure sets forth an apparatus for school supply station. However, one of ordinary skill in the art could readily apply the novel teachings of this disclosure to any number of apparatuses, including, for example, party platters. As such, the teachings of this disclosure shall not be considered to be limited to the specific examples disclosed herein, but to include all applications within the spirit and scope of the invention.

We claim:

1. A school supply station for storing classroom items, the supply station comprising:

an annular inner wall defining an interior bin receiving area;

an annular outer wall spaced radially outward from and connected to the inner annular wall by a series of bottom walls;

a plurality of divider walls oriented transverse to and extending between the inner wall and outer wall, thereby forming a series of compartments; and a bin removably disposed in the bin receiving area;

wherein the series of compartments includes an alternating series of side compartments and corner compartments; and wherein the outer wall is taller near the transverse divider walls of the corner compartments and shorter away from the transverse walls.

2. The supply station of claim 1, wherein the outer wall further comprises a plurality of mid-segments and a plurality of curved sections interconnecting the mid-segments.

3. The supply station of claim 2, wherein the outer wall is vertically shorter than the inner wall.

4. The supply station of claim 2, wherein the outer wall mid-segments are angled from the bottom walls away from the inner wall at a first angle.

5. The supply station of claim 4, wherein the outer wall curved sections are angled from the bottom walls away from the inner wall at a second angle greater than the first angle, and the bottom walls attached to the outer wall linear sections are higher than the bottom walls attached to the outer wall curved sections.

6. The supply station of claim 2, wherein the outer wall mid-segments meet the bottom wall at a curved transition surface.

7. The supply station of claim 1, the bin receiving area comprising a rim extending inward from the inner wall, and at least one hole disposed in the rim, the hole adapted to retain elongate articles.

8. The supply station of claim 1, wherein the inner wall comprises a plurality of wall segments interconnected at corners.

9. The supply station of claim 8, wherein the transverse divider walls extend out from the inner wall segments near the corners and are oriented perpendicularly to the inner wall segments.

10. The supply station of claim 8, wherein the corner compartments extend out from the corners of the inner walls, and the side compartments are positioned outward from the inner wall segments.

11. The supply station of claim 1, wherein the bin receiving area comprises a rim extending inward from the inner wall, a neck extending downward from the rim, and a shoulder extending inward from the neck.

12. The supply station of claim 1, wherein the outer wall includes a lip extending outward and downward.

13. The supply station of claim 12, wherein the lip includes irregularities to enhance grip.

14. A school supply station for storing classroom items, the supply station comprising:

an annular inner wall;

an annular outer wall spaced radially outward from and connected to the inner annular wall by a series of bottom walls;

a plurality of divider walls oriented transverse to and extending between the inner wall and outer wall, thereby forming a series of compartments;

a bin receiving area comprising a rim extending inward from the annular inner wall, a neck extending downward from the rim, and a shoulder extending inward from the neck; and a bin removably disposed in the bin receiving area, the bin including a base and a sidewall extending up from the base;

wherein the sidewall of the bin includes a shoulder adapted to bear on the shoulder of the bin receiving area such that the bin is held in an elevated state.

15. The supply station of claim 14, wherein the bin includes a rim, the rim being spaced upward above the rim of the bin receiving area when the bin is held in an elevated state.

16. The supply station of claim 14, wherein the bin includes dividers dividing the bin into four chambers.

17. The supply station of claim 16 wherein the height of the chambers are at least four times the length or width.

18. The supply station of claim 16, wherein the bin includes a bottom that includes channels extending upward into the bin.

19. A school supply station for storing classroom items, the supply station comprising:

an annular inner wall;

an annular outer wall spaced radially outward from and connected to the inner annular wall by a series of bottom walls;

a plurality of divider walls oriented transverse to and extending between the inner wall and outer wall, thereby forming a series of compartments; and a bin removably disposed within the annular inner wall, the bin including a base and a sidewall extending up from the base and at least one bin divider that divides the bin into a plurality of chambers; the base of the bin further including at least one channel that extends upward into the bin, wherein the channel is disposed directly below the bin divider.

* * * * *